US005899193A

United States Patent [19]

Betz II et al.

[11] Patent Number: 5,899,193

[45] Date of Patent: May 4, 1999

[54] DIESEL ENGINE FUEL SYSTEM AND METHOD OF PRIMING

[75] Inventors: Gerard George Betz II, Royal Oak, Mich.; Barry Alan Ivers, Mesa, Ariz.

[73] Assignee: General Motors Corporation, Detroit, Mich.

[21] Appl. No.: 08/972,488

[22] Filed: Nov. 18, 1997

[51] Int. Cl.[6] ..... F02M 37/04

[52] U.S. Cl. ..... 123/516; 123/179.17; 123/179.11

[58] Field of Search ..... 123/516, 179.17, 123/179.11, 456, 510, 509

[56] References Cited

U.S. PATENT DOCUMENTS

| | | | |
|---|---|---|---|
| 1,495,315 | 5/1924 | Ball | 123/179.11 |
| 4,625,694 | 12/1986 | Adey | 123/516 |
| 4,694,810 | 9/1987 | Miyamoto | 123/516 |
| 4,984,554 | 1/1991 | Ariga | 123/179.17 |
| 5,103,793 | 4/1992 | Riese | 123/516 |
| 5,231,967 | 8/1993 | Baltz | 123/516 |
| 5,762,050 | 6/1998 | Gonzalez | 123/516 |

FOREIGN PATENT DOCUMENTS

| | | | |
|---|---|---|---|
| 0112419 | 9/1979 | Japan | 123/516 |
| 0200663 | 12/1982 | Japan | 123/516 |
| 0048768 | 3/1983 | Japan | 123/516 |
| 0085357 | 5/1983 | Japan | 123/516 |
| 1395969 | 5/1975 | United Kingdom | 123/516 |

*Primary Examiner*—Carl S. Miller
*Attorney, Agent, or Firm*—Karl F. Barr, Jr.

[57] ABSTRACT

A fuel system and method for priming a diesel engine fuel system after assembly or when run out of fuel in which the system has a filter that can trap air allowing drainback of fuel to the tank. The system is provided with a fuel priming connection to the injection pump inlet, the connection having a closure for shutting the connection when not in use. A mechanically openable check valve, such as a Schraeder valve, is a preferred form of closure. The system is primed by reverse flow of fuel from the priming connection through the filter to the fuel tank to virtually eliminate trapped air from the system. The engine may then be started with a minimum of cranking. The engine may be restarted after running out of fuel by partially filling the tank and operating the normal feed pump while bleeding air from the system through the priming connection, which is closed prior to engine starting. The engine may then be reprimed after shutdown if required.

9 Claims, 1 Drawing Sheet

DIESEL ENGINE FUEL SYSTEM AND METHOD OF PRIMING

TECHNICAL FIELD

This invention relates to diesel engine fuel systems and, more particularly, to priming of such systems.

BACKGROUND OF THE INVENTION

It is known in the art relating to priming of fuel systems (either gasoline or diesel) to completely assemble the entire system and install approximately 5 gallons of fuel in the fuel tank. Then, using the in-tank electric feed pump, the system is primed from the fuel tank, through the fuel feed line, through a fuel rail or diesel injection pump, and then back through the return line to the fuel tank.

In a known fuel system, which includes a fuel filter between the fuel tank and a direct injection diesel fuel injection pump, the prior method of priming is not acceptable. A small orifice in the injection pump housing limits the flow of priming fuel through the system. Further, the fuel filter housing has a top connected inlet and a bottom feeding outlet. A portion of the air in the filter is trapped in the housing above the outlet when fuel is fed in the normal direction from the tank to the injection pump. Particularly when the filter is mounted above the fuel tank in the system, the trapped air allows fuel in the line to the filter to drain back to the fuel tank when the feed pump is shut off. The problem is greater as the filter is mounted higher in the system. When attempting to start the engine thereafter, some of the trapped air is pumped to the inlet of the fuel injection pump, causing it to be air bound and preventing engine starting.

If a vehicle with this known system were to run out of fuel in operation, air in the system would prevent restarting of the engine even after fuel was delivered to the fuel tank. This would require bleeding of the fuel lines to eliminate the trapped air in order to allow engine restart and permit the fuel system to again perform in the desired manner.

SUMMARY OF THE INVENTION

The present invention overcomes the prior problems by assembling the entire fuel system without fuel and then, through a reverse flow process, priming the entire system. The entire system is reverse-primed, leaving little or no trapped air in the fuel filter, thereby providing a liquid lock on the high spot of the system. This prevents the flow of fuel back into the fuel tank when the engine is shut off and allows quick restarts with no air being ingested by the injection pump.

To provide for reverse priming, a priming line is connected to a connector at the inlet of the fuel injection pump. The priming line is provided with a closure, preferably a mechanically openable check priming valve of the type used for filling and maintaining air pressure in tires, such as a Schraeder valve. The valve allows fuel to be forced into the priming line and to flow to the injection pump and also back through a delivery line to the filter housing. All air is thus forced out of the housing through the top inlet as the fuel continues through the feed line to the fuel tank.

In case a vehicle runs out of fuel in normal operation, the engine may be restarted upon replacement of a small amount of fuel in the tank. This is accomplished by mechanically holding open the priming valve while the in-tank fuel feed pump is operated. When fuel reaches the priming valve, the valve is closed and the engine may be restarted. If necessary, any remaining trapped air may be removed later by reverse priming of the system as before described.

These and other features and advantages of the invention will be more fully understood from the following description of a particular embodiment of the invention taken together with the accompanying drawing.

DESCRIPTION OF THE PREFERRED EMBODIMENT

Figure 1:
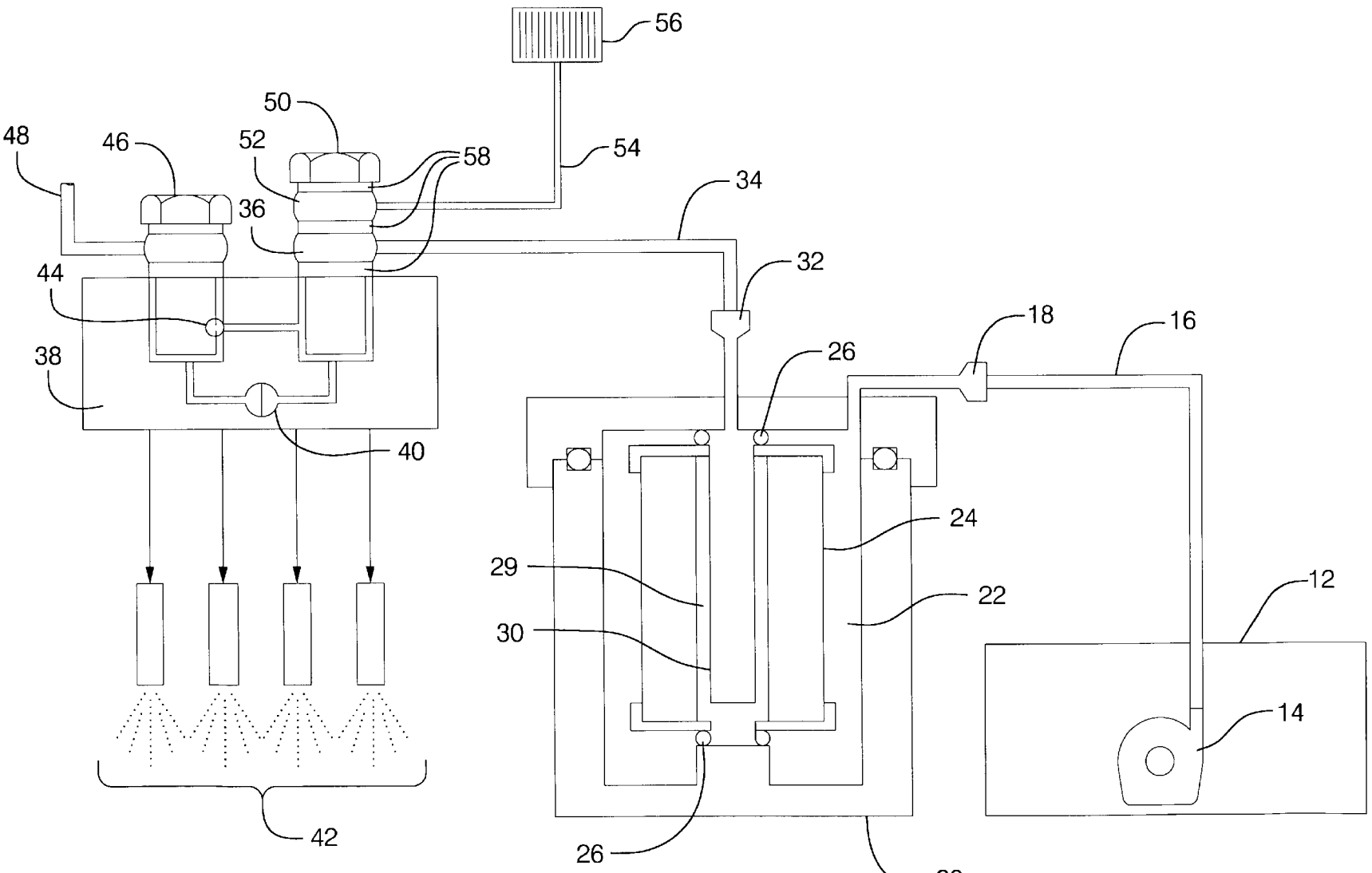
FIG. 1 is schematic view illustrating the elements of a diesel engine fuel system according to the invention.

In the drawing, numeral 10 generally indicates a diesel engine fuel system as mounted in a vehicle in accordance with the invention. System 10 includes a fuel tank 12 within which is located an electric feed pump 14 connected with a feed line 16 passing out through an upper portion of the fuel tank 12.

Line 16 connects with an inlet connection 18 through the top of a fuel filter housing 20 with an internal filter chamber 22. Within the chamber 22 is a disposable filter element 24 of annular form, having an outer surface exposed to fuel entering the chamber 22 through the inlet connection 18. Seals 26 seal the outer portion of the chamber 22 from an inner annulus 28 inside the filter element 24 which connects with the lower end of a tubular center core 30 that leads to a fuel outlet connection 32 for the filter element 24.

A fuel delivery line 34 joins the outlet connection 32 with a banjo type fuel inlet fitting 36 for a fuel injection pump 38. The injection pump 38 has internal pumping means 40 that deliver fuel to individual injection nozzles 42 for direct injection into the cylinders of an associated engine, not shown. A small air bleed orifice 44 bypasses the pumping means and connects through a fuel outlet fitting 46 with a fuel return line 48 leading back to the fuel tank 12.

A banjo bolt 50 connects the inlet fitting 36 with the injection pump 38. In accordance with the invention, bolt 50 also mounts a priming fitting 52 that connects a through a priming line 54 with an inlet check valve 56. Valve 56 is preferably like the mechanically actuatable type used in vehicle tires to allow their inflation and prevent the escape of air unless actuated to an open position. A Schraeder valve is an example of such check valves. Copper washers 58 seal the joints and allow fuel flow between the priming line 54, injection pump 38 and delivery line 34.

To prime the fuel system 10 after assembly, diesel fuel is delivered through the check valve 56 and priming line 54 to the inlet fitting 36 of the injection pump 38. The fuel is also forced back through the delivery line 34, the filter housing 20 and the feed line 16 to the fuel tank 12. In the filter housing 20, the fuel is delivered through the center core 30 to a lower portion of the inner annulus 28 and flows outward through the filter element 24 and upward through the chamber 22, forcing out virtually all the air in the housing 20.

Thus, virtually all the air between the injection pump and the fuel tank in the system 10, as assembled, is removed by causing the reverse flow of fuel to the tank 12, leaving a liquid lock of liquid fuel in the system from the tank to the injection pump. Accordingly, startup of the engine occurs with a minimum of cranking and the return of fuel through the injection pump thereafter also fills the return line with fuel and forces out any remaining air therein.

Should the vehicle be inadvertently run out of fuel in subsequent operation, air will reach the injection pump inlet, causing an air lock. However, the engine may be restarted, after partially refilling the fuel tank 12, by operating the feed pump 14 in the tank 12 while, at the same time, mechanically opening the priming check valve 56. This allows air in the system to bleed off while the pump 14 delivers fuel to the injection pump inlet 36. When fuel reaches the check valve 56, the valve is closed and the engine may be restarted. If necessary, upon stopping of the engine, any air trapped in the filter housing may be removed thereafter by reverse priming of the system as previously described.

While the invention has been described by reference to a preferred embodiment, it should be understood that numerous changes could be made within the spirit and scope of the inventive concepts described. Accordingly it is intended that the invention not be limited to the disclosed embodiment, but that it have the full scope permitted by the language of the following claims.

We claim:

1. Fuel system for a direct injection diesel engine vehicle, said system including:

a fuel tank enclosing a feed pump with an outlet in an upper portion of the tank;

a fuel filter housing having an inlet located above and connected with the outlet of the feed pump;

an injection pump having an inlet connected with the filter housing, said injection pump connected with injectors for delivering fuel to the engine; characterized by a fuel priming line connected with said injection pump inlet, said priming line having an inlet with means to prevent fuel flow therethrough unless opened;

whereby said fuel system may be reverse primed by pumping fuel through the priming line to the injection pump inlet and then through the fuel filter housing to the fuel tank, thus eliminating substantially all trapped air from the filter housing and connecting lines and avoiding air locking of the system during engine shutdown.

2. A fuel system as in claim 1 wherein said means to prevent fuel flow through the inlet of the fuel priming line includes a mechanically openable check valve arranged and to allow fuel inflow through the priming line to the injection pump inlet but to prevent fluid outflow from the priming line except when the check valve is opened.

3. A fuel system as in claim 1 wherein said injection pump receives fuel through an inlet connector and said priming line connects with said inlet connector to deliver fuel for reverse flow priming of the system.

4. A fuel system as in claim 1 wherein said feed pump is driven by an electric motor in the tank.

5. A fuel system as in claim 1 and including a replaceable filter element in the filter housing wherein fuel flow from the tank passes into an upper portion of the filter housing, inward through the filter element, downward to the end of a tubular center core and upward to a housing outlet.

6. A method for priming a fuel system for a diesel engine vehicle having a fuel tank enclosing a feed pump with an outlet in an upper portion of the tank, a fuel filter housing having an inlet located above and connected with the outlet of the feed pump, and an injection pump having an inlet connected with the filter housing, said injection pump connected with means for delivering fuel to the engine; characterized by:

providing a fuel priming connection to the injection pump inlet;

providing closure means for said priming connection: and supplying fuel to the system through the fuel priming connection by reverse flow through the fuel filter housing to the fuel tank.

7. A method as in claim 6 wherein said closure means of the priming connection is a mechanically openable check valve normally preventing outflow from the fuel system.

8. A method for restarting a diesel engine which has run out of fuel in a vehicle having a fuel tank enclosing a feed pump with an outlet in an upper portion of the tank, a fuel filter housing having an inlet located above and connected with the outlet of the feed pump, and an injection pump having an inlet connected with the filter housing, said injection pump connected with means for delivering fuel to the engine; characterized by:

providing a fuel priming connection to the injection pump inlet with closure means for said priming connection;

partially filling the fuel tank with fuel;

operating the feed pump while opening the closure means of the priming connection to bleed air from the system as fuel is pumped therein; and closing the closure means of the priming connection when fuel had reached the injection pump inlet and prior to restarting the engine.

9. A method as in claim 8 wherein said closure means of the priming connection is a mechanically openable check valve normally preventing outflow from the fuel system.

* * * * *